US005318258A

United States Patent [19]

Lang

[11] Patent Number: 5,318,258

[45] Date of Patent: Jun. 7, 1994

[54] PORTABLE HIGHWAY SIGN STAND

[76] Inventor: Paul A. Lang, 555 14th St., Newport, Minn. 55055

[21] Appl. No.: 954,311

[22] Filed: Sep. 30, 1992

[51] Int. Cl.[5] ..... G09F 15/00

[52] U.S. Cl. ..... 248/166; 40/603; 40/606

[58] Field of Search ..... 248/166, 291, 316.4; 40/603, 606, 607, 612

[56] References Cited

U.S. PATENT DOCUMENTS

| | | | |
|---|---|---|---|
| 1,901,879 | 3/1933 | Schiffmann | 40/607 |
| 4,115,966 | 9/1978 | DeLee | 40/607 |
| 4,288,053 | 9/1981 | Sarkisian | 40/607 |
| 4,676,015 | 6/1987 | Stoudt | 40/606 |
| 4,951,407 | 8/1990 | Werner | 40/608 |
| 4,980,984 | 1/1991 | Kulp et al. | 40/610 |

OTHER PUBLICATIONS

"Vizistand System" by Lang Products International, Inc. 1991.

*Primary Examiner*—Richard K. Seidel
*Assistant Examiner*—Hwei-Siu Payer
*Attorney, Agent, or Firm*—Burd, Bartz & Gutenkauf

[57] ABSTRACT

A portable collapsible highway sign stand for standard rollup and rigid warning, regulatory and informational signs. An elongated vertical rigid sign-supporting mast is supported by a multi-legged base. The legs are pivotally supported for movement from a first folded position parallel to the mast to a second position in which the legs are splayed outwardly and secured in place by a single central retainer pin. A sign mounting jaw including a first fixed outer jaw and a slidable inner jaw member is secured to the top of the mast. A mast tilt adjuster is incorporated to adapt use of the sign stand to non-level terrain.

20 Claims, 4 Drawing Sheets

PORTABLE HIGHWAY SIGN STAND

BACKGROUND OF THE INVENTION

1. Field of the Invention

This invention relates to a portable sign stand for supporting standard rollup or rigid warning, regulatory or informational signs, usually along roads and highways. Because such signs are used temporarily in connection with road construction or repair, temporary hazardous driving situations, protection of workmen and survey crews, and the like, they must be readily collapsible into a small storage configuration and portable, as well as sturdy and durable, capable of withstanding windy conditions, easy to set up and take down, etc.

2. The Prior Art

Werner U.S. Pat. No. 4,951,407 and Kulp et al U.S. Pat. No. 4,980,984 are exemplary of patents directed to highway signs of the type to which this invention is directed.

SUMMARY OF THE INVENTION

Broadly stated the present invention is directed to a portable collapsible highway sign stand for displaying standard rollup and rigid warning, regulatory and informational signs. The sign stand comprises an elongated vertical rigid mast of rectangular cross-section supported by a multi-legged base connected to the bottom end of the mast. The legs are pivotally supported on a bracket for movement through about 90 to 140 degrees from a first storage position parallel to the mast to a second position in which the legs are splayed outwardly and secured in place by a single central retainer pin passing through aligned holes in the bottom brackets and engageable by the innermost ends of the splayed legs. A sign mounting jaw is secured to the topmost end of the mast and includes a first fixed outer jaw secured to the mast and a slidable inner jaw member. A sign to be supported is engaged between the inner and outer jaw members and rigidly held in place by closing the jaws together by turning a handle. A sign stop is provided on the mast underlying the jaw for determining the elevation of the sign relative to the ground. A mast tilt adjuster is incorporated in the lower section of the mast to adapt use of the sign stand to sloping ground.

BRIEF DESCRIPTION OF THE DRAWINGS

The invention is illustrated by the accompanying drawings in which corresponding parts are identified by the same numerals and in which.

DETAILED DESCRIPTION OF THE PREFERRED EMBODIMENT

Figure 1:
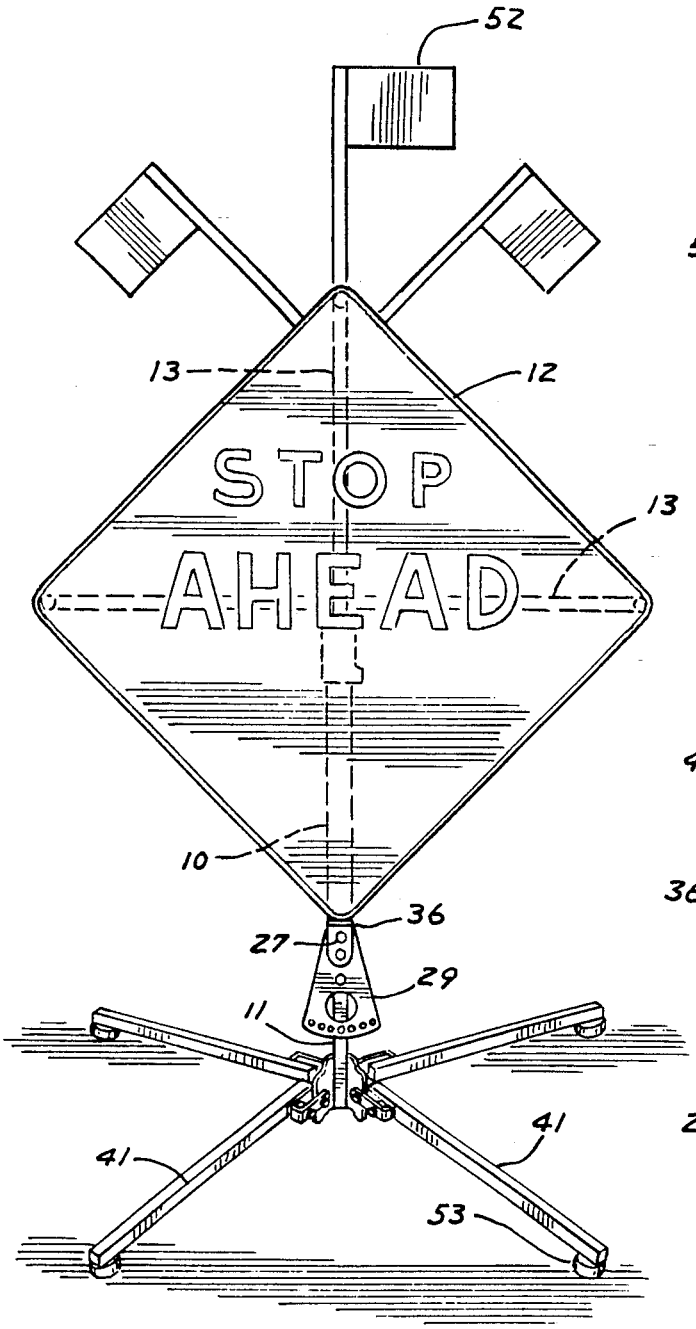
FIG. 1 is a perspective view in front elevation of a sign stand according to the present invention shown supporting a standard rollup traffic warning sign.

Referring now to the drawings, the sign stand according to the present invention comprises an elongated vertical rigid mast including a relatively longer upper section 10 and a relatively shorter lower section 11. The mast is of rectangular cross-section and preferably is formed of rectangular metal tubing to minimize weight. The mast is supported by a multi-legged base, as described in detail hereinafter.

The mast supports a sign bearing an informational, regulatory or warning message. The most usual form of sign is a standard rollup sign 12, as shown, formed of fabric. The rollup sign is rectangular in shape and oriented diagonally in the familiar diamond shape. The reverse side of the rollup sign has a pocket or other fastening means at each corner to engage the ends of a pair of semi-rigid struts or braces 13 extending diagonally and usually formed of fiberglass. By use of an adaptor compatible with the sign mounting jaw, standard rigid signs of aluminum of plywood likewise may be supported and displayed.

The sign mounting jaw includes a first fixed outer jaw member having a flat center section 14 secured to the mast, as by bolts 15. The outer jaw member includes a first end section 16 and a second end section 17 extending at generally right angles in the same direction from the opposite ends of the center jaw section 14. A lip 18 extends inwardly from the end of outer jaw end section 16. The center portions 19 of outer jaw center section 14 by which the outer jaw is secured to the mast are spaced apart and offset slightly to provide a transverse passage for receiving the flat center section 20 of a second longitudinally reciprocable inner jaw member slidable within that passage. The inner jaw member includes a first end section 21 and a second end section 22 extending at generally right angles in the same direction from the ends of the inner jaw center section 20.

The end sections 21 and 22 of the inner jaw member are spaced from the respective end sections 16 and 17 of the outer jaw member by a distance sufficient to receive a vertical brace 13 of a sign 12. At least the inner surface of outer jaw end section 16 and outer surface of inner jaw end section 21 are preferably provided with a protective lining or coating of a rubber or rubber-like material to prevent abrasion or other damage to the brace 13 and to ensure firm, uniform engagement of the jaw end sections with the sign brace. In order to operate the jaw an internally threaded collar 23 is provided on the outside surface of outer jaw end section 17. A threaded stud 24 having a handle 25 is engaged within collar 23. The innermost end of stud 24 engages the outer surface of inner jaw end section 22. Rotation of stud 24 by handle 25 advances stud 24 toward the outside surface of inner jaw end section 22 and causes the inner jaw to be moved toward outer jaw end section 16 into tight gripping engagement with the vertical sign brace 13. Upon release of the clamp, the brace is easily removed.

Reverse rotation of stud 24 by handle 25 backs off the stud and leaves the inner jaw free to slide inside the outer jaw, thereby releasing the grip on brace 13 and allowing sign removal.

Figures 2, 2A, 3, 3A:
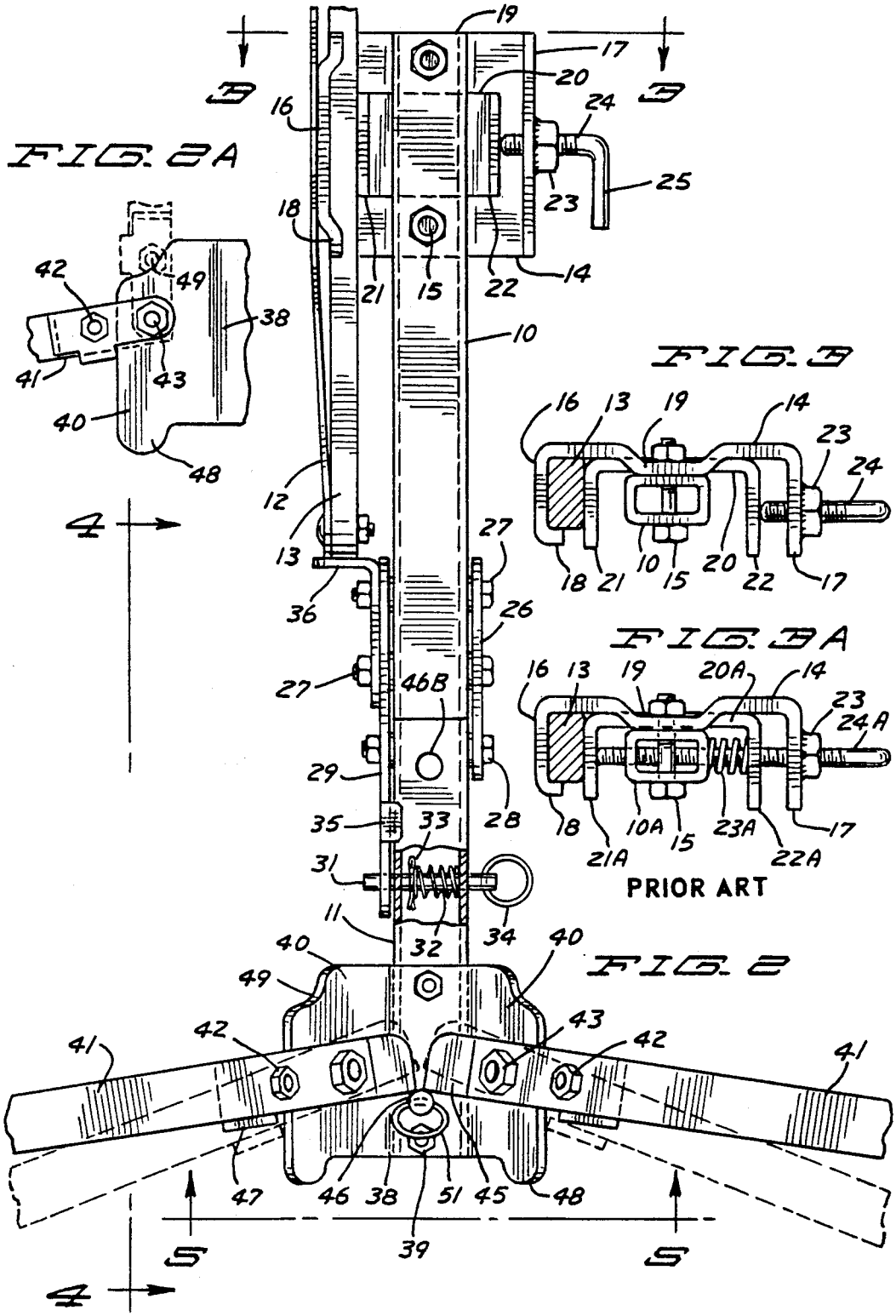
FIG. 3A PRIOR ART
FIG. 2 is a fragmentary right side elevation of the sign stand on an enlarged scale.
FIG. 2A is a fragmentary elevational view of one end of a primary support bracket showing stop means incorporated therein.
FIG. 3 is a plan view of the top end of the mast, on the line 3—3 of FIG. 2 and in the direction of the arrows, showing details of construction of the sign mounting jaw.
FIG. 3A is a similar plan view of a forerunner of the present mounting jaw.

A forerunner of the present sign mounting jaw is shown in FIG. 3A. The outer jaw member is identical in all respects to that already described. Inner jaw end section 22A has a hole therein for free passage of an elongated threaded stud 24A. The upper section of mast 10A has aligned holes in its opposite sides for freely receiving stud 24A. Gripping force is exerted on the sign brace 13 by virtue of the end of stud 24A engaging the inner surface of inner jaw end section 21A upon rotation of the stud by the handle. A compression spring 23A is positioned around the stud between the inside surface of inner jaw end section 22A and the mast to separate outer jaw end section 18 and inner jaw end section 21A upon reverse rotation of stud 24A by the handle.

Figure 4:
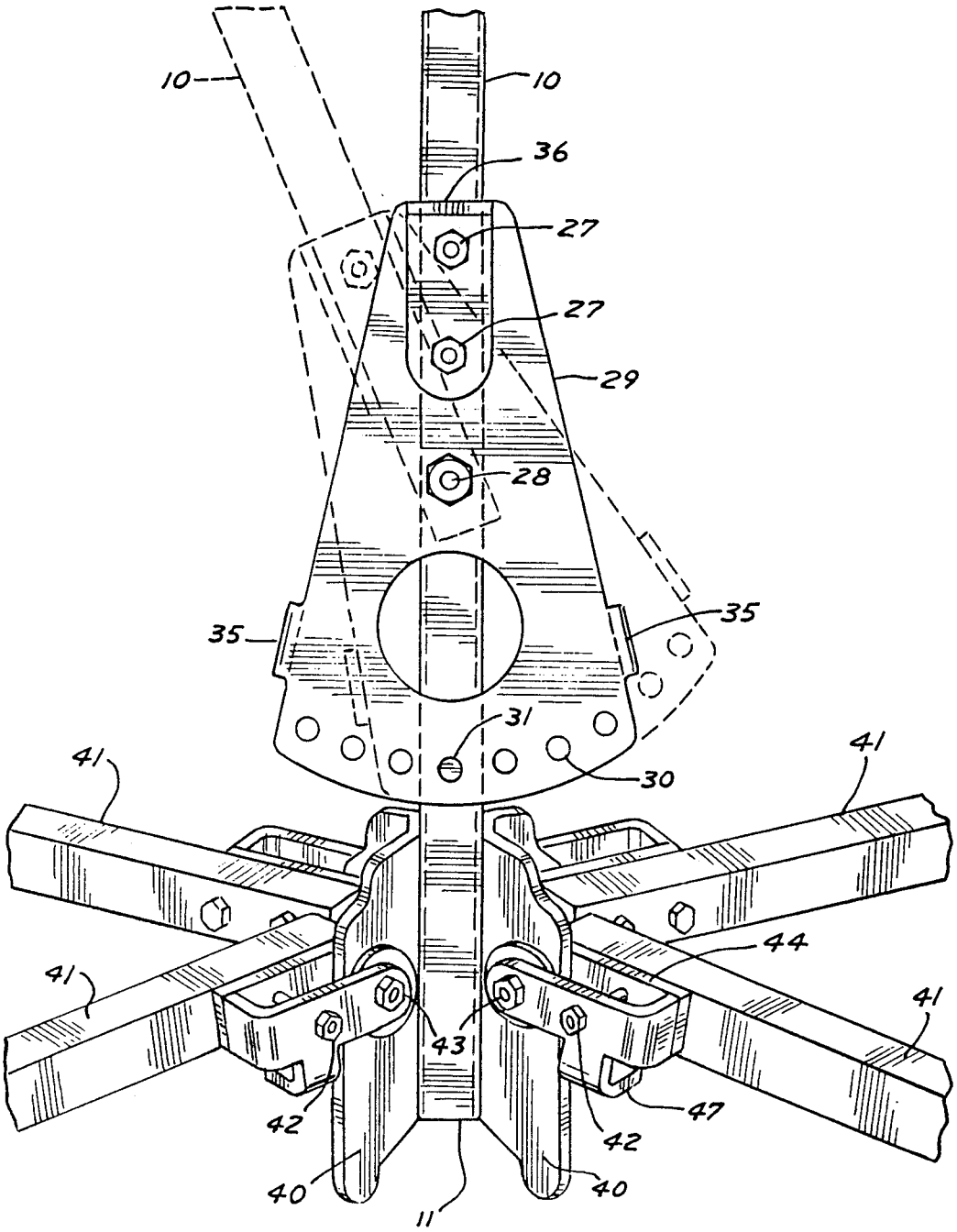
FIG. 4 is a fragmentary front elevation on an enlarged scale, on the line 4—4 of FIG. 2 and in the direction of the arrows, showing details of construction of the mast tilt adjuster.

In order to enable the mast to remain generally vertical when the sign stand is used on sloping roadway shoulders or other non-level ground surfaces, a multiple setting tilt adjustment mechanism is provided. A first strap or plate 26 is rigidly secured to the bottom end of upper mast section 10, as by bolts 27, or welding, and is pivotally secured to the top end of the lower mast section, as by bolt 28. A second plate 29 of generally triangular configuration is rigidly secured to the opposite side of upper mast section 10, parallel to plate 26, and secured by the same bolts 27, or welded. Plate 29 in turn is pivotally connected to the top end of the lower mast section 11 by the same bolt 28 as plate 26. As seen in FIG. 4 the top mast section 10 can be rotated angularly to one side or the other of the lower mast section after the sign stand is set up, as required by the terrain.

In order to fix the upper mast section in the selected position, plate 29 is provided with a plurality of uniformly spaced apart holes 30 in an arcuate pattern, the holes being uniformly spaced on a downward radius from the axis of the pivotal connection 28 of plate 29 to the lower mast section. A lock pin 31 extends freely through aligned holes in opposite sides of the lower mast section and through one of holes 30 in plate 29. Lock pin 31 is preferably spring biased by virtue of a compression spring 32 held in place between the inner surface of the mast and cotter pin 33. To tilt the mast, ring 34 attached to the opposite end of pin 31 is pulled against the force of spring 32 until the lock pin is released from one of holes 30 in plate 29. The mast is rotated to the best vertical position and upon release of ring 34 the lock pin engages the hole 30 which corresponds most closely to the mast angle, thereby securing the mast in tilted position. To limit the extent of tilting, stops 35, which are engageable with lower mast section 11, are provided extending rearwardly from the opposite side edges of plate 29. Although the tilt adjuster is shown with plates 26 and 29 fixedly secured to the upper mast section 10 and pivotally secured to the lower mast section 11, this structure may be reversed with plates 26 and 29 fixedly secured to the lower mast section 11 and pivotally secured to upper mast section 10.

A sign stop 36 is provided extending from upper mast section 10 to engage the bottommost edge of sign 12 or the bottom edge of a rigid sign adapter. Sign stop 36 extends outwardly and underlies the jaw formed between the respective first end sections 16 and 21 of the outer and inner jaw members The sign stop 36 may be slidably and lockably secured to the upper mast section above the tilt adjuster but below the mounting jaw or, as shown, it may be attached to the mast by the same bolts 27 as the tilt adjuster plates 26 and 29.

The support base for the sign stand is connected to the bottom end of the lower mast section 11. The support base includes a pair of symmetrical mirror image primary brackets each having a flat center section 38 rigidly secured in parallel relation to opposite sides of the mast, as by means of bolts 39. Bolts 39 may be made of a material, such as aluminum, which breaks under a high load such as that generated by an accidental vehicular impact. With the sign set up breakage of bolts 39 will cause the entire mast assembly to rotate downwardly along a predetermined plane away from the vehicle. Each primary bracket has an outwardly extending end section 40. End sections 40 extend angularly at angles of about 110 to 170 degrees from the flat center section 38. An elongated rigid leg 41 is rigidly secured, as by means of bolt 42, to a yoke-like bifurcated secondary bracket pivotally mounted, as by bolt 43, to the end section 40 of the primary bracket. The first secondary bracket segment 44 is complementary to the primary bracket and is shaped with about a 110 to 170 degree angular extension 45. Thus, the secondary bracket segment 44–45 spaced from primary bracket 38–40 by the thickness of a washer conforms generally to the angular cross-sectional shape of the primary bracket.

Figure 5:
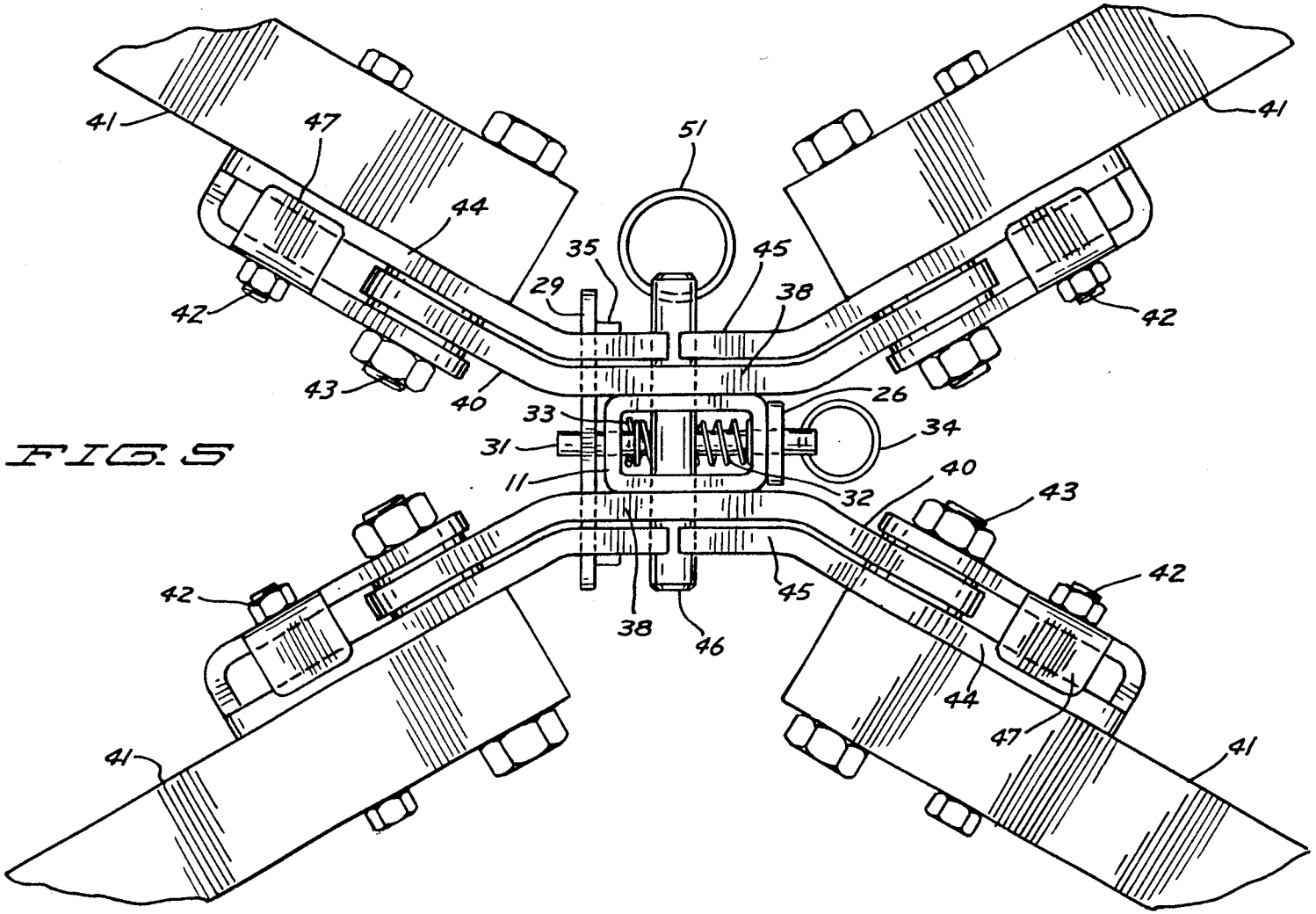
FIG. 5 is a bottom plan view on an enlarged scale, on the line 5—5 of FIG. 2 and in the direction of the arrows, showing details of construction of the leg mounting brackets and support assembly.

As seen in FIGS. 2 and 5 the ends 45 of the secondary bracket segments supporting the legs 41 are closely spaced apart when the legs are in splayed position. The ends of the secondary bracket segments are spaced apart by a distance less than the diameter of retainer pin 46 so that, when the pin 46 is in place in hole 46A through both primary support bracket 40 and lower mast section 11, the legs are retained in their outwardly extending splayed position and prevented from rotation toward the first position parallel to the mast to support the sign stand and sign.

Figure 6:
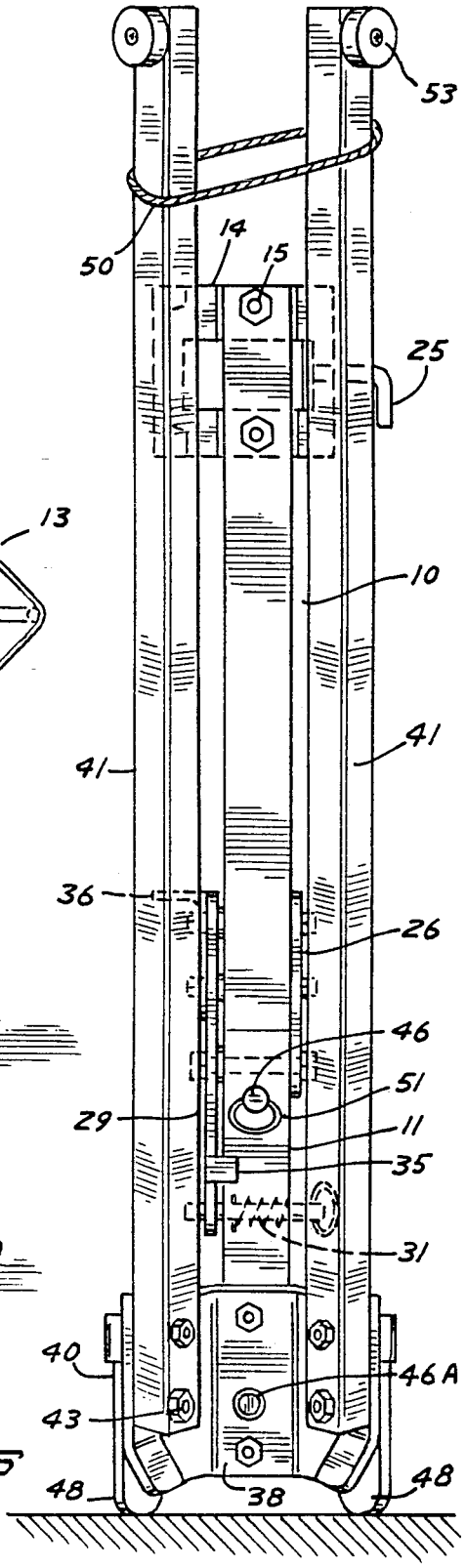
FIG. 6 is an elevation of the sign stand shown with the support legs folded inwardly against the mast and secured for carrying or storage.

As shown by comparison of FIGS. 6 and 2, the legs 41 may be rotated on pivot 43 through an angle of about 90 to 140 degrees from a first position parallel to the mast. When the sign is being set up, releasing storage loop 50 will permit the leg 41 to rotate on pivot 43 into splayed position with foot pads 53 on the ends of legs in contact with the ground. In this position the secondary support bracket segments 45 partially block retainer pin hole 46A. Further rotation of the legs elevates the ends of the secondary bracket segments above hole 46A to free the hole for insertion of retainer pin 46 through both primary support brackets and the bottommost end of the mast, extending beyond the hole for engagement by the secondary brackets. This further rotation of the legs is accomplished by the operator's slight lifting of the sign stand mast with one hand. Leg rotation is limited by stops 47 on the secondary brackets engaging the end edges of primary bracket end sections 40. The retainer pin is inserted by the operator using one hand while the other hand holds the sign stand slightly elevated. When the mast is released and the stand is lowered to the ground the bracket end sections 45 of adjacent legs engage the retainer pin and maintain the legs in stable ground engaging position.

The sign stand may be erected in no more than ten seconds. It may be taken down just as easily by lifting the stand slightly to disengage the secondary bracket end segments 45 from the retainer pin 46, withdrawing the pin, and folding the legs upwardly until they are parallel to the mast and secured by storage loop 50. The legs are maintained in their upright folded position by means of an elastic storage loop 50 or a strap or other similar restraining means. Preferably the end sections 40 of the primary support brackets are provided with foot-like members 48 to support the folded stand. A notch 49 is provided in the upper edge of the end sections 40 of the primary support brackets. As seen in FIG. 2A, bolt 42 engages notch 49 and functions as a stop when the legs are in their folded position.

For ease in inserting and removing retainer pin 46, it is provided with a ring 51. Preferably the retainer pin is tethered, as by means of a cable, chain or cord, to prevent it from being separated from the rest of the sign stand. For storage convenience, a retainer pin storage hole 46B is provided through the mast lower section 11 on an axis perpendicular to the hole pattern of the tilt plate 29.

For maximum visibility a set of flags 52 is desirably mounted on top of sign 12. Legs 41 are desirably of rectangular tubular construction. They may be of one piece or telescopic structure. Ground engaging foot pads 53 are desirably provided at the end of each leg 41.

It is apparent that many modifications and variations of this invention as hereinbefore set forth may be made without departing from the spirit and scope thereof. The specific embodiments described are given by way of example only and the invention is limited only by the terms of the appended claims.

I claim:

1. A collapsible portable highway sign stand for standard rollup and rigid signs comprising:

A) an elongated vertical rigid mast of rectangular cross section having on upper section and a lower section, B) a support base connected to the bottom end of said mast, said base including:

1) a pair of symmetrical mirror image primary support brackets each having a flat center section secured to opposite sides of the mast and a pair of angularly outwardly extending end sections, 2) an elongated rigid leg pivotally secured to each of said primary bracket end sections, said legs being movable through about 90 to 140 degrees from being parallel to said mast to being splayed outwardly from the bottom of the mast, 3) a complementary secondary support bracket segment rigidly secured to the innermost end of each leg and pivotally secured to said primary bracket end sections, said segments conforming in cross-sectional profile to said primary brackets, the innermost ends of said bracket segments on adjacent legs on each bracket being in closely spaced relation, 4) centrally located aligned holes through said primary brackets and mast adjacent the bottom edges thereof, and 5) a central retainer pin insertable into said holes to engage said innermost ends of said secondary bracket segments to lock said legs in splayed extended position, C) a sign mounting jaw secured to the topmost end of said mast and including:

1) a first fixed outer jaw member having a flat center section secured to the mast, and first and second end sections extending at generally right angles in the same direction from the ends of the center section, 2) an inwardly extending lip on the end of said first end section, 3) a second longitudinally reciprocable inner jaw member within said outer jaw member and having a flat center section slidable between the mast and inner surface of the outer jaw, and first and second end sections extending at generally right angles in the same direction from the inner jaw center section and spaced from the end sections of the fixed jaw member, 4) a screw threaded stud extending through the second end section of the fixed outer jaw member, the inner end of said stud bearing against the outside surface of the second end section of the reciprocable inner jaw member for reciprocation thereof, D) a sign stop extending outwardly from the upper section of the mast and underlying the jaw formed between the first end sections of the inner and outer jaw members, and E) a mast tilt adjuster including:

1) a first plate fixed to the end of one of the mast sections and pivotally connected to the end of the other section of the mast on one side thereof, 2) a second plate fixed to the end of the same section of the mast as the first plate on the opposite side thereof and parallel to said first plate, said second plate being pivotally connected to the end of the other section of the mast on the same axis of rotation as said first plate, 3) a plurality of spaced apart holes in at least one of said plates spaced from the pivotal connection to the mast, said holes being radially uniformly spaced from the axis of rotation in an arcuate pattern, 4) a hole in each of the opposite sides of the mast in alignment with the holes in said plate, and 5) a lock pin extending through said holes in the mast and plate.

2. A portable sign stand according to claim 1 wherein each of said secondary support brackets includes a transverse stop means spaced outwardly from the pivotal connection to the primary support bracket and engageable with the side edges thereof to limit downward movement of the legs.

3. A portable sign stand according to claim 1 wherein,

A) each of said secondary support brackets is rigidly secured to each corresponding leg by a bolt spaced from the pivotal connection to each end section of the primary bracket, and B) a notch is provided in the upper outside edge of each of said primary support bracket end sections engageable as stop means with said bolts.

4. A portable sign stand according to claim 1 wherein said mast and said legs are of one-piece rectangular tubular construction.

5. A portable sign according to claim 1 wherein:

A) the first tilt adjuster plate is fixed to the bottom end of the upper section of the mast and pivotally connected to the top end of the lower section of the mast on one side thereof, and B) the second plate is fixed to the bottom end of the upper section of the mast on the opposite side thereof and parallel to said first plate.

6. A portable sign stand according to claim 5 wherein said sign stop extends outwardly from the top end of the second of said tilt adjuster plates 7. A portable sign stand according to claim 1 wherein
A) said plurality of spaced apart holes are provided only in the second of said tilt adjuster plates,
B) the lock pin is partially housed within the mast, and
C) the mast is spring biased by virtue of a compression spring around the pin within the mast.

8. A portable sign stand according to claim 1 wherein
A) said second tilt adjuster plate is of generally triangular configuration and
B) tilt stop means are provided extending rearwardly from opposite side edges of said plate.

9. A portable sign stand according to claim 1 wherein at least the inner surface of the first outer jaw end section and the outer surface of the first inner jaw end section are provided with a protective resilient rubber or rubber-like coating or lining.

10. A portable sign stand according to claim 9 wherein
A) said plurality of spaced apart holes are provided only in the second of said tilt adjuster plates,
B) the lock pin is partially housed within the mast, and
C) the mast is spring biased by virtue of a compression spring around the pin within the mast.

11. A portable sign stand according to claim 9 wherein
A) said second tilt adjuster plate is of generally triangular configuration, and
B) tilt stop means are provided extending rearwardly from opposite side edges of said plate.

12. A portable sign stand according to claim 9 wherein said mast and said legs are of one-piece rectangular tubular construction.

13. A collapsible portable highway sign stand for standard rollup and rigid signs comprising:
A) an elongated vertical rigid mast of rectangular cross-section having an upper section and a lower section,
B) a multi-legged support base connected to the bottom of said mast,
C) a sign mounting jaw secured to the top most end of said mast,
D) a sign stop extending outwardly from the upper section of the mast and underlying said jaw, and
E) a mast tilt adjuster including:
1) a first plate fixed to the end of one of the mast sections and pivotally connected to the end of the other section of the mast on one side thereof,
2) a second plate fixed to the end of the same section of the mast as the first plate on the opposite side thereof and parallel to said first plate, said second plate being pivotally connected to the end of the other section of the mast on the same axis of rotation as said first plate,
3) a plurality of spaced apart holes in at least one of said plates spaced from the pivotal connection to the mast, said holes being radially uniformly spaced from the axis of rotation in an arcuate pattern,
4) a hole in each of the opposite sides of the mast in alignment with the holes in said plate, and
5) a lock pin extending through said holes in the mast and plate.

14. A portable sign according to claim 13 wherein:
A) the first tilt adjuster plate is fixed to the bottom end of the upper section of the mast and pivotally connected to the top end of the lower section of the mast on one side thereof, and
B) the second plate is fixed to the bottom end of the upper section of the mast on the opposite side thereof and parallel to said first plate.

15. A portable sign stand according to claim 14 wherein said sign stop extends outwardly from the top end of the second of said tilt adjuster plates.

16. A collapsible portable highway sign stand for standard rollup and rigid signs comprising:
A) an elongated vertical rigid mast of rectangular cross-section,
B) a multi-legged support base connected to the bottom end of said mast,
C) a sign mounting jaw secured to the top most end of said mast and including:
1) a first fixed outer jaw member secured to the mast and having a flat center section, and first and second end sections extending at generally right angles in the same direction from the ends of the center section,
2) an inwardly extending lip on the end of said first end section,
3) a second longitudinally reciprocable inner jaw member within said outer jaw member and having a flat center section slidable between the mast and inner surface of the outer jaw, and first and second end sections extending at generally right angles in the same direction from the inner jaw center section and spaced from the end sections of the fixed jaw member, and
4) a screw threaded stud extending through the second end section of the fixed outer jaw member, the inner end of said stud bearing against the outside surface of the second end section of the reciprocable inner jaw member for reciprocation thereof, and
D) a sign stop extending outwardly from the mast and underlying the jaw formed between the first end sections of the inner and outer jaw members.

17. A portable sign stand according to claim 16 wherein at least the inner surface of the first outer jaw end section and the outer surface of the first inner jaw end section are provided with a protective resilient rubber or rubber-like coating or lining.

18. A portable sign stand according to claim 16 wherein said mast and said legs are of one-piece rectangular tubular construction.

19. A collapsible portable highway sign stand for standard rollup and rigid signs comprising:
A) an elongated vertical rigid mast of rectangular cross-section,
B) a multi-legged support base connected to the bottom end of said mast, said base including:
1) a pair of symmetrical mirror image primary support brackets each having a flat center section secured to opposite sides of the mast and a pair of angularly outwardly extending end sections,
2) an elongated rigid leg pivotally secured to each of said primary bracket end sections, said legs being movable through about 90 to 140 degrees from being parallel to said mast to being splayed outwardly from the bottom of the mast,
3) a complementary secondary support bracket segment rigidly secured to the innermost end of each leg and pivotally secured to said primary bracket end sections, said segments conforming in cross-sectional profile to said primary brackets, the innermost ends of said bracket segments on adjacent legs on each bracket being in closely spaced relation, 4) transverse stop means on each of said secondary support brackets spaced outwardly from the pivotal connection to the primary support bracket and engageable with the side edges thereof to limit downward movement of the legs, 5) a bolt spaced from the pivotal connection to each end section of the primary bracket and rigidly securing each of said secondary support brackets to each corresponding leg, 6) centrally located aligned holes through said primary brackets and mast adjacent the bottom edges thereof, and 7) a central retainer pin insertable into said holes to engage the innermost ends of said secondary bracket segments to lock said legs in splayed extended position, C) a sign mounting jaw secured to the topmost end of said mast, and D) a sign stop extending outwardly from the upper section of the mast, and underlying the sign mounting jaw.

20. A collapsible portable sign stand according to claim 19 wherein:

A) a notch is provided in an upper edge of each of the end sections of said primary support brackets, and B) said bolts are engageable therein to limit rotational movement of said legs to a folded position parallel to the mast.

* * * * *

UNITED STATES PATENT AND TRADEMARK OFFICE

CERTIFICATE OF CORRECTION

PATENT NO. : 5,318,258

DATED : June 7, 1994

INVENTOR(S) : PAUL A. LANG

It is certified that error appears in the above-identified patent and that said Letters Patent is hereby corrected as shown below:

Column 5, line 35, "on" should be ---an---;

Column 7, line 3, a period ---.--- should be inserted at the end of the line;

Signed and Sealed this

Eleventh Day of October, 1994

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,318,258

DATED : June 7, 1994

INVENTOR(S) : Paul A. Lang

It is certified that error appears in the above-indentified patent and that said Letters Patent is hereby corrected as shown below:

Col. 7, line 21, "9" should read ---13---.
Col. 7, line 29, "9" should read ---13---.
Col. 7, line 35, "9" should read ---13---.

Signed and Sealed this

Eleventh Day of April, 1995

*Attest:*

Bruce Lehman

BRUCE LEHMAN

*Attesting Officer*

*Commissioner of Patents and Trademarks*